United States Patent [19]

Pickard et al.

[11] 4,024,928

[45] May 24, 1977

[54] FIRE ESCAPE INSTALLATION

[75] Inventors: John Frederick Pickard; Gillian Susan Pickard, both of Beaworthy, England

[73] Assignee: Montrose Properties Limited, England

[22] Filed: Dec. 24, 1975

[21] Appl. No.: 644,197

[30] Foreign Application Priority Data

Jan. 8, 1975 United Kingdom ..... 726/75

[52] U.S. Cl. ..... 182/19; 182/36; 182/34; 52/1; 52/29; 52/69

[51] Int. Cl.² ..... A62B 3/00

[58] Field of Search ..... 182/34, 48, 12, 18, 182/19, 36; 52/1, 49, 29, 69, 192, 195; 49/131, 141, 217

[56] References Cited

UNITED STATES PATENTS

| | | | |
|---|---|---|---|
| 479,533 | 7/1892 | Schultz | 14/71 |
| 670,050 | 3/1901 | Hull | 182/48 |
| 1,380,229 | 5/1921 | Manheim | 14/71 |
| 3,327,335 | 6/1967 | Beckwith | 14/71 M |
| 3,440,782 | 4/1969 | Stone | 14/71 |

FOREIGN PATENTS OR APPLICATIONS

| | | | |
|---|---|---|---|
| 1,963,393 | 8/1971 | Germany | 14/71 |

*Primary Examiner*—Reinaldo P. Machado
*Attorney, Agent, or Firm*—Cushman, Darby & Cushman

[57] ABSTRACT

A fire escape unit for installation in buildings such as hospitals includes a hinged platform upon which a movable load such as a bed to be evacuated in an emergency is mounted. The hinged end of the platform is adjacent a hinged portion of an external wall of the building and in the event of a fire the hinged platform is released to adopt an outwardly sloping position and the external wall portion hinged outwards to form an inclined ramp, on to which the bed rolls from the platform, the platform lifting to fill the aperture in the external wall after the bed has passed through to minimize the ingress of air.

10 Claims, 2 Drawing Figures

FIRE ESCAPE INSTALLATION

BACKGROUND OF THE INVENTION

This invention relates to fire escape installations in buildings.

The invention has particular, but not exclusive, reference to fire escape installations in hospitals and homes for the elderly in which the occupants are bed-ridden. Such buildings present an acute fire hazard, since in the event of a fire it is difficult to evacuate the occupants safely and quickly, even if adequate numbers of staff and firemen are at hand to move individual patients. The problem is aggravated in certain hospital wards where individual patients may be connected to surgical instruments or appliances so that they cannot quickly be moved from their beds without risk of injury.

An object of the present invention is to provide an economically practical solution to this problem. The essential concept of this invention as applied to hospitals and like buildings is to provide for the removal of a bed, with its occupant, from the confines of a building in the event of a fire. The bed is positioned adjacent an external wall of the building, and in the event of a fire being detected a movable section of the external wall is released to provide an aperture through which the bed moves, preferably by gravity-assistance, to a safe position on the outside of the building, where the occupant of the bed can easily be rescued.

In practice the removal of the bed from the building in the event of a fire should preferably take place automatically when the adjoining wall section is released, without requiring manual operation or motive power, neither of which may be available.

SUMMARY OF THE INVENTION

According therefore to one aspect of the present invention there is provided a fire escape unit for installation in a building, comprising a normally vertical wall hinged at its lower end about a horizontal axis, a normally horizontal platform adapted to support a mobile load such as a castor-mounted bed, the platform being hinged at an end adjacent the wall about a horizontal axis parallel to or coincident with the hinge axis of the wall, actuator means operable to cause the platform to adopt an inclined position in which it slopes downwardly towards the wall and to cause outward movement of the wall about its hinge axis into an outwardly projecting position in which it forms a ramp acting as a continuation of the inclined platform, so that the mobile load can move under the influence of gravity from the platform on to the ramp formed by the wall.

Upon detecting a fire the actuator means are operated, allowing the platform to adopt its inclined position, and at the same time causing the hinged wall to fall outwardly to form an inclined ramp which is an effective continuation of the platform. The mobile load, which in a hospital installation would comprise a wheeled or castor-mounted bed, then moves, under gravity, through the aperture in the wall of the building which was previously closed by the hinged wall, on to the ramp.

When the bed has been removed from the building the aperture in the external wall through which the bed has passed should preferably be covered, preferably by an automatically operated closure, to minimise the ingress of air and so retard the spread of the fire, and to protect the bed which has been expelled from the building.

Preferably, therefore, the unit includes means acting on the platform to more the latter upwardly about its hinge axis so that, upon operation of the actuator means, when the mobile load has left the platform and moved onto the ramp formed by the lowered wall, the platform moves into a position substantially filling the aperture vacated by the lowered wall. In this way the ingress of air into the building through the aperture in the external wall is minimised, restricting the supply of oxygen to the fire in the building.

The platform and the wall may be provided with longitudinally extending guides, for example guide rails, for guiding the movement of the mobile load when the wall forms a ramp. In addition, a resilient stop or buffer may be provided on the hinged wall to limit the outward movement of the load over the ramp formed by the wall.

The actuator means may in practice comprise resilient biasing means urging the platform upwardly, releasable locking means for locking the wall and the platform in vertical and horizontal positions of use respectively, and a release mechanism for releasing the said locking means so as to permit upward movement of the platform about its hinge axis into its inclined position and outward movement of the wall to form the ramp.

The release mechanism may be manually operable by the operation of a single manual release member such as a lever, and preferably the operation of this release member should be possible both from the inside and the outside of the building. Alternatively, but preferably in addition, an automatic release mechanism may be provided, in the form of, for example, alectromagnetic, hydraulic or pneumatic actuators operable automatically under control of fire- or smoke-detecting means.

The fire escape unit according to the invention is of such constructional simplicity that it can easily be installed in existing buildings without extensive modification.

Although particularly applicable to the escape of bedridden patients from buildings in fire emergencies, the invention is also applicable to private dwellings. More generally, the invention is also applicable to buildings used for the storage of valuable or highly inflammable goods. Such goods may be arranged on wheeled trolleys or carriages, or on skids, which in this case would constitute the mobile load referred to above, for automatic removal from a building through apertures in the external walls in the event of a fire, analagously to the removal of individual beds from a building.

Thus the invention also provides a safety ejection unit for installation in a building, comprising a normally horizontal platform adapted to support a mobile load, the platform being hinged at one end about a horizontal axis, an external wall section adjoining the hinged end of the platform, resilient means urging the platform into an inclined position in which it slopes downwardly towards the hinged end, a door hinged at its upper end to the wall section about a horizontal hinge axis, at a height greater than that of the mobile load to be supported on the platform, locking means for locking the platform in its horizontal position, a release mechanism for releasing the locking means to allow the platform to adopt its inclined position under the influence of the resilient means, and means for unlocking the door so that a mobile load on the platform can move along the platform under the influence of gravity and pass through the door outwards, the door closing again assisted by its own weight after the load has moved outside of the wall section. Actuator means may be provided for moving the door into its open position when unlocked, operation of the actuator means being triggered by the release mechanism.

The present invention also comprehends, in another aspect, a building equipped with fire escape unit as herein described. In such a building individual mobile loads such as castor-mounted beds or wheeled pallets, carriers or slidable load carriers, according to the use to which the building is put, may be supported on individual hinged platforms installed in the floor of the building, as previously described. Alternatively, each mobile load may be supported on an outwardly and downwardly sloping floor adjoining an external wall, the building having at least one walled section hinged at its lower end about its horizontal axis for movement from a normal vertical position to an outwardly projecting position in which it forms a downwardly sloping ramp which is an effective continuation of the sloping floor, the wall section being normally held in its vertical position by releasable locking means which may be manually or automatically releasable.

When a building is equipped with a fire escape unit according to the invention a clear area must be provided around the external walls of the building to allow the hinged wall section to hinge outwardly to form inclined ramps. A stop or support in the form of, for example, a ridge or wall may be provided at a suitable distance from the external wall of the building to support the or each wall section when it falls outwardly to form a ramp. Such an arrangement is not at variance with normal building practice for hospitals and the like, which generally stipulates a clear area outside each external wall for ease of access by emergency services.

It should be noted that although particularly applicable to the ground floor of buildings, the invention is also applicable to upper floors, if suitable supports are provided outwardly of the external walls of the building to support the or each hinged wall section when it falls outwardly to form a ramp: once a bed or other mobile load has moved onto such a ramp this can easily be reached by rescue services.

In another embodiment of the invention a building has an otuwardly and downwardly sloping floor adjoining an external wall, at least one normally substantially vertical door hinged at its upper end about a horizontal hinge axis defining the upper edge of an aperture in the external wall at a height greater than that of a load to be supported on the sloping floor, and releasable locking means for locking said door in its normal position. When the locking means are released the load moves under gravity on the inclined floor, and pushes the door outwards and upwards about its hinge. In this case the exterior of the building would normally be provided with a fixed ramp structure to receive the load when it passes through the aperture in the external wall of the building. This embodiment has the advantage that the hinged door recloses under its own weight after the load has passed through the opening in the wall of the building thereby restricting the influx of air into the building.

BRIEF DESCRIPTION OF THE DRAWINGS

A practical embodiment of the invention is illustrated, merely by way of example, in the accompanying purely diagrammatic drawings, in which.

DETAILED DESCRIPTION OF THE ILLUSTRATED EMBODIMENTS

The drawings illustrate part of a dormitory building such as a hospital or home for the elderly having a floor 1 and an external side wall 2. The ground 3 immediately outside of the building is lower than the floor level on the interior of the building and is clear of obstruction over a distance at least equal to the height of the wall 2.

Figure 1:
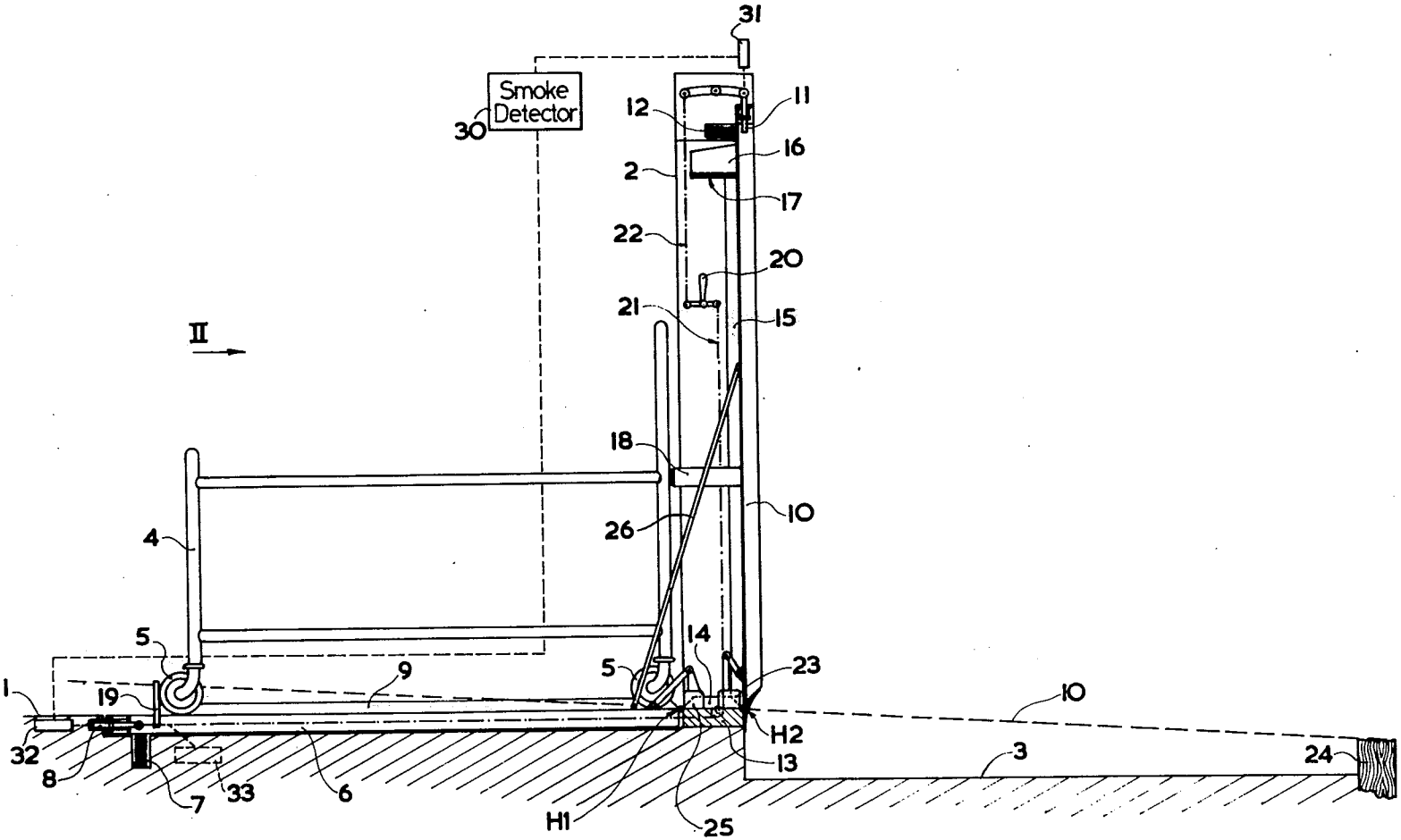
FIG. 1 is a partly sectional side elevation of a fire escape unit according to the invention as applied to a hospital bed.

A hospital bed 4 of standard construction having supporting wheels 5 is arranged, in a conventional manner, with its head end adjacent the external wall 2. Instead of resting directly on the floor 1, however, the bed 4 is supported on a horizontal platform 6 which has a length and width greater than that of the bed 4. The platform 6 is hinged at one end, adjacent the wall 2, about a horizontal axis H1 parallel to the side wall. Helical coil springs 7 embedded in pockets in the floor 1 beneath the platform 6 adjacent the free end of the latter, opposite the hinge axis H1, urge the platform 6 upwardly with a force, for example 25 pounds weight, such that when the bed 4, with an occupant, rests on the platform 6 the springs 7 are capable of maintaining the platform 6 in an inclined position, indicated in broken outline in FIG. 1, in which it is inclined downwardly towards the hinge axis H1 at an angle of approximately 3° to the horizontal, this angle being sufficient to cause the bed 4 to roll outwardly along the platform 6 under the influence of gravity.

In normal use the platform 6 is maintained in a horizontal position, as shown, by retractable bolts 8 in the free end of the platform 6, thereby maintaining the springs 7 in compression. The bolts 8 are retractable in an emergency, as hereinbefore described.

A pair of longitudinally extending guide rails 9 are provided on the upper surface of the platform 6 to guide the rolling movement of the bed 4. The guide rails 9 in this example consist simply of angle-section bars secured to the upper surface of the platform 6. Instead of the guide rails 9 there could alternatively be provided guide channels recessed into the surface of the platform 6.

The external wall 2 is provided with an emergency exit opening of a sufficient width and height to allow the bed 4 to pass therethrough. This opening is normally closed by a hinged wall section 10 which is hinged at its lower end for movement about a horizontal axis H2 parallel to the axis H1. The wall section 10 is normally held in a vertical position by one or more releasable bolts 11, located in the external wall, which engage in apertures in the upper edge of the wall section 10. A number of helical coil springs 12 are housed in pockets in an upper outwardly facing part of the wall 2 and engage the inner surface of the hinged wall section 10 opposite its hinge axis H2. The spring 12 are held in a state of compression when the wall section 10 is locked in its vertical position by the bolts 11.

A horizontal sill 13 defines the bottom of the emergency escape aperture in the wall 2 and has an upper surface which is inclined at the same angle to the horizontal as the platform 6 when the latter is released into its inclined position (broken lines). This upper surface of the sill 13 and the adjacent inner surface of the hinged wall section 10 are provided with respective pairs of guide rails 14, 15 which form effective continuations of the guide rails 9 on the platform 6.

A fixed stop 16 is located at the upper end of the guide rail 15 on the inside surface of the hinged wall section 10, the stop 16 being provided with a rubber buffer 17 on its downwardly facing surface. The distance between the buffer 17 and the hinge axis H2 is greater than the overall length of the bed 4. A fixed bed positioning stop 18 having a rubber facing is attached to the inside face of the hinged wall section 10 and is located between the two guide rails 15.

OPERATION

In use of the installation the bed 4 is positioned on the platform 6 with its wheels 5 between the positioning stop 18. The bed is locked in this position by the insertion of removable stops 19 in suitably located apertures in the guide rails 9, immediately behind the rear wheels 5 of the bed, thereby preventing movement of the bed 4 away from the positioning stop 18.

The locking bolts 8 and 11 are releasable simultaneously by movement of a release lever 20 located in the side wall 2. The lever 20 is connected by respective cables 21, 22 indicated by chain dotted lines, to the respective bolts 8 and 11, so that movement of the lever 20 into a release position releases both bolts 8 and 11 simultaneously. As illustrated the release lever 20 is located inside the building for operation by the occupant of the bed 4 or an attendant or nurse within the building. In addition a further lever (not shown) may be provided on the outside of the building and coupled to the lever 20, so that the latter can be operated by rescue workers. This further lever may be accessible through a breakable panel coupled to an alarm system so that breakage of the panel automatically sets off a fire alarm.

In the event of a fire emergency the lever 20 is operated to release the bolts 8 and 11 as described above. The platform 6 is lifted by the action of the springs 7 into its inclined position, shown in broken outline, and at the same time the hinged wall section 10 is pushed outwardly by the springs 12 and falls outwards under its own weight. The outward movement of the wall section 10 is damped by an hydraulic damper 23 of commercially available type and is checked when the free end of the wall section 10 comes to rest on an external stop 24, which may, for example, comprise a low horizontal wall or parapet spaced outwardly from the side wall 2 of the building. The height of the stop 24 is such that when the wall section 10 rests thereon it is inclined otuwardly and downwardly at an angle to the horizontal (approximately 3°) equal to the angle of inclination of the raised platform 6.

The bed 4, with its occupant, is now free to roll under the influence of gravity over the sill 13 and on to the downwardly inclined ramp formed by the wall section 10, until it comes to rest against the buffered stop 16, when the bed 4 will be outside the confines of the building. In this position rescue of the occupant from the bed can easily be effected, The stop 16 may in practice be removable to facilitate removal of the bed 4 from the ramp wall section 10 after evacuation of the bed from the building.

In order to retard the spread of a fire in the building it is important that once the bed 4 has been evacuated the emergency exit aperture be closed to restrict the flow of air into the building. Such closure is easily effected in the illustrated embodiment by means of a door re-closer 25 of conventional construction which acts upon the hinged platform 6 and urges the latter upwardly after the load (that is, the bed 4) has left the platform 6, lifting the platform 6 into a vertical position, blocking the exit aperture. Any convenient alternative means of lifting the platform 6 into the vertical position may be provided.

The descent of the wall section 10 under gravity may be utilised to operate pneumatic or hydraulic jacks (not shown) through a suitable linkage for the purpose of lifting the platform 6 into the vertical position.

Two counter-balance spring 26 (not shown in FIG. 2) interconnect the hinged platform 6 and the wall section 10 and serve to counter-balance the weight of the platform 6 and the weight of the bed 4 resting thereon, so as to assist the action of the release springs 7. Alternatively, or in addition, helical coil or leaf springs may be provided at the hinge of the platform 6 to provide a counter-balancing effect. The counterbalance springs 26 may be sufficiently strong to bias the platform 6 upwardly with a force such as to render the release springs 7 unnecessary.

In the particular application of the present invention to hospitals and nursing homes, each individual bed, once located and retained on the platform 6 of the escape unit, is left with its wheels 5 unlocked and unbraked, so as to be free to roll when the platform 6 is tilted. Any ancillary medical equipment attached to a patient in the bed, such as a drip feed, for example, would be attached by any suitable means to the head or frame of the bed and would be arranged so that it can pass through the escape aperture in the external wall 2 upon movement of the bed in an emergency. Where such an arrangement is not possible, suitably long and flexible extension leads would connect the patient to any fixed apparatus so as to permit unfettered movement of the bed as described herein in an emergency.

In view of the fact that the hinged platform 6, when raised to the vertical position, forms an effective fire wall, blocking the emergency exit aperture after the bed 4 has been evacuated from the building, the platform 6 would in practice be faced, at least on its underside, that is the side which faces into the building when the platform 6 is raised to the vertical position, with a fireproof lining, for example of asbestos sheet.

Figure 2:
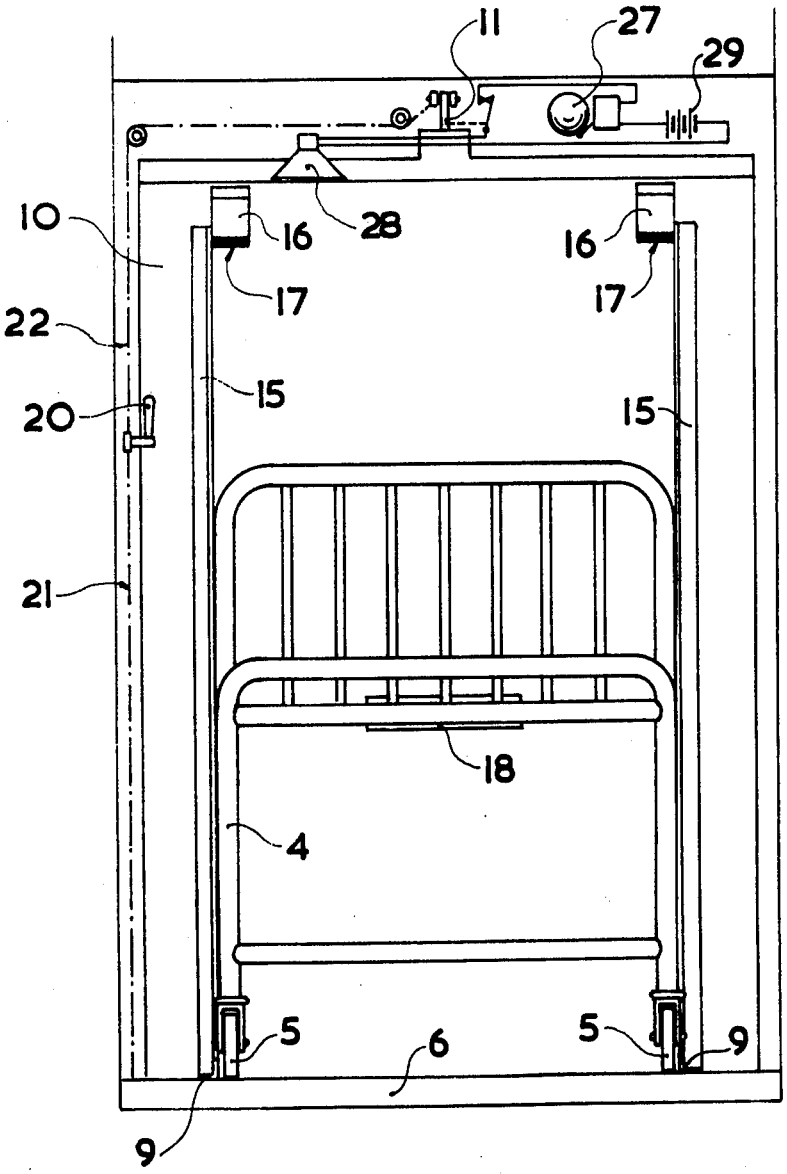
FIG. 2 is an end elevation in the direction of arrow II in FIG. 1

An emergency circuit, shown diagrammatically, powered by a battery 29, is operatively associated with the release mechanism, for example with one of the bolts 11, as shown in FIG. 2, so that when the bolts 8, 11 are released the circuit is completed to operate a warning bell 27 and an emergency light 28 which illuminated the inclined ramp 14 formed by the wall section 10, facilitating rescue in the event of electrical power failure in the building.

The escape unit will be oerated only in an emergency when a fire occurs in the building. Automatic operation may be triggered off by means of a fire or smoke detector 30, shown diagrammatically, connected in an energising circuit for respective solenoids 31, 32 which retract the bolts 8, 11 respectively upon detection of a fire by the detector 30.

As described and illustrated the invention is particularly applicable to single storey or ground floor installations in buildings. The invention is, however, also applicable with advantage to multi-storey buildings. For example, if an escape unit according to the invention were to be installed on a floor above ground level, an outside verandah or alternatively an external fire escape structure of the type already in use may be modified to receive the wall section 10, when the latter falls outwardly to form an inclined ramp, and to restrain the bed safely until rescue can be effected. Alternatively, in the absence of an existing verandah or fire escape structure a acaffolding type structure may be erected on the outside of the building with supports at appropriate levels designed to receive the ramps on which the beds are carried.

In the illustrated embodiment the release springs indicated diagrammatically at 7, and the releasable locking bolt 8, may be dispensed with in favour of an actuator, shown diagrammatically in broken outline at 33 arranged upon operation to engage the platform 9 and move it positively into its inclined position. This acutator 33 may be electromagnetic, pneumatic or hydraulic, or may alternatively comprise a mechanical device such as crank arm connected to a mechanical lever. For example, a group of platforms 9 along one side of a building may be movable by operation of a single control member such as a lever.

We claim:

1. A fire escape unit for installation in a building, comprising:

- fixed support structure;
- a normally vertical wall hinged at its lower end to the support structure for pivotal movement about a horizontal axis,
- a normally horizontal platform adapted to support a mobile load such as a castor-mounted bed,
- means pivotally attaching one end of the platform adjacent the wall to the fixed support structure for pivotal movement about a horizontal axis parallel to the hinge axis of the wall, and
- actuator means operable to cause the platform to adopt an inclined position in which it slopes downwardly towards the wall and to cause outward movement of the wall about its hinge axis into an outwardly projecting position in which it forms a ramp acting as a continuation of the inclined platform, whreby the mobile load can move under the influence of gravity from the platform on to the ramp formed by the wall upon operation of the actuator means.

2. The unit defined in claim 1, including means acting on the platform to move the latter upwardly about its hinge axis when the mobile load has moved from the platform onto the ramp formed by the wall so as substantially to fill the aperture vacated by the outwardly projecting wall.

3. The unit defined in claim 1, wherein the actuator means comprise resilient biasing means urging the platform upwardly, releasable locking means for locking the wall and the platform in vertical and horizontal positions respectively and a release mechanism for releasing said locking means so as to permit upward movement of the platform into its inclined position and outward movement of the wall to form the ramp.

4. The unit defined in claim 1, wherein the platform and the wall are provided with longitudinally extending guides for guiding the movement of the mobile load.

5. The unit defined in claim 4, wherein a resilient stop or buffer is provided on the hinged wall to limit the outward movement of the mobile load over the ramp formed by the wall.

6. The unit defined in claim 1, including a single manual release member for operating the actuator means.

7. The unit defined in claim 3, including electromagnetic actuators operable to release the locking means.

8. The unit defined in claim 1, including fire detecting means operatively associated with the actuator means to effect automatic operation thereof in the event of a fire.

9. A safety ejection unit for installation in a building, comprising:

- a normally horizontal platform adapted to support a mobile load, the platform being hinged at one end about a horizontal axis,
- an external wall section adjoining the hinged end of the platform,
- a resilient means urging the platform into an inclined position in which it slopes downwardly towards the hinged end,
- a door hinged at its upper end to the wall section about a horizontal hinge axis, at a height greater than that of the mobile load to be supported on the platform,
- locking means for locking the platform in its horizontal position,
- a release mechanism for releasing the locking means to allow the platform to adopt its inclined position under the influence of the resilient means, and
- means for unlocking the door so that a mobile load on the platform can move along the platform under the influence of gravity and pass through the door outwards, the door closing again assisted by its own weight after the load has moved outside of the wall section.

10. The safety ejection unit defined in claim 9, including actuator means for moving the door into its open position when unlocked, the actuator means being operated by the release mechanism.

* * * * *